US006878677B1

(12) United States Patent
Sakanoue et al.

(10) Patent No.: US 6,878,677 B1
(45) Date of Patent: Apr. 12, 2005

(54) REFRIGERATING MACHINE OIL COMPOSITIONS

(75) Inventors: Shuichi Sakanoue, Ichihara (JP); Masahiko Takesue, Ichihara (JP); Youichiro Jido, Ichihara (JP); Minoru Takagi, Tokyo (JP); Shoichi Tominaga, Tokyo (JP); Hiroshi Nagakawa, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 09/926,106

(22) PCT Filed: Mar. 1, 2000

(86) PCT No.: PCT/JP00/01197

§ 371 (c)(1),
(2), (4) Date: Sep. 4, 2001

(87) PCT Pub. No.: WO00/53704

PCT Pub. Date: Sep. 14, 2000

(30) Foreign Application Priority Data

Mar. 5, 1999 (JP) ..... 11-058387
Apr. 1, 1999 (JP) ..... 11-094530

(51) Int. Cl.[7] ..... C10M 107/24; C10M 141/10

(52) U.S. Cl. ..... 508/433; 508/436; 508/440; 508/485; 508/486; 508/487; 508/513; 508/539; 508/551; 508/579; 252/68

(58) Field of Search ..... 252/67, 68; 508/486, 508/487, 433

(56) References Cited

U.S. PATENT DOCUMENTS 5,021,179 A 6/1991 Zehler et al.
5,122,288 A * 6/1992 Shiraishi et al. ..... 508/497
5,310,492 A 5/1994 Seiki et al.
5,403,503 A 4/1995 Seiki et al.
5,464,550 A 11/1995 Sasaki et al.
5,538,654 A * 7/1996 Lawate et al. ..... 508/308
5,792,383 A 8/1998 Reyes-Gavilan et al.
5,843,873 A 12/1998 Butke et al.
5,858,266 A 1/1999 Kaneko
5,879,748 A * 3/1999 Conti et al. ..... 427/391
5,908,818 A * 6/1999 Egawa et al. ..... 508/579
5,997,761 A * 12/1999 Kaneko ..... 252/68
6,193,906 B1 * 2/2001 Kaneko et al. ..... 252/68
6,261,474 B1 * 7/2001 Egawa et al. ..... 252/68
6,454,960 B1 * 9/2002 Sunaga et al. ..... 252/67
6,656,891 B1 * 12/2003 Sakanoue et al. ..... 508/579

FOREIGN PATENT DOCUMENTS

| | | |
|---|---|---|
| EP | 0 399 377 | 11/1990 |
| EP | 461 262 | 12/1991 |
| EP | 0 461 262 | 12/1991 |
| EP | 507 158 | 10/1992 |
| EP | 557 104 | 8/1993 |
| EP | 0 714 974 | 6/1996 |
| EP | 0 732 391 | 9/1996 |
| EP | 0 735 127 | 10/1996 |
| EP | 785 247 | 7/1997 |
| EP | 0 785 247 | 7/1997 |
| EP | 0 786 510 | 7/1997 |
| EP | 0 861 883 | 9/1998 |
| EP | 0 997 519 | 5/2000 |
| GB | 2 324 801 | 11/1998 |
| JP | 60-173097 | 9/1985 |
| JP | 9-25492 | 1/1997 |
| WO | WO 92/01030 | 1/1992 |
| WO | WO 93/01249 | 1/1993 |
| WO | WO 93/24596 | 12/1993 |
| WO | WO 96/07721 | 3/1996 |

* cited by examiner

*Primary Examiner*—Ellen McAvoy
(74) *Attorney, Agent, or Firm*—Oblon, Spivak, McClelland, Maier & Neustadt, P.C.

(57) ABSTRACT

The invention provides a refrigerator oil composition comprising a base oil of a mineral oil and/or a synthetic oil, and containing (a) a partial ester of a polyalcohol and a fatty acid and (b) an acid phosphate or its amine salt; and a refrigerator oil composition comprising a base oil of a mineral oil and/or a synthetic oil, and containing any of (a) acid phosphates or their amine salts, (b) acetylene glycol alkylene oxide adducts, (c) potassium salts of fatty acids, etc., (d) organic acids, and (e) fatty acid amides. The refrigerator oil compositions have good lubricity and are especially effective for reducing the friction in both the oil region and the extreme-pressure region in the sliding area between aluminium materials and steel materials.

18 Claims, No Drawings

REFRIGERATING MACHINE OIL COMPOSITIONS

CONTINUING APPLICATION INFORMATION

This application is a National Stage of International Application No. PCT/JP00/01197, filed on Mar. 1, 2000.

TECHNICAL FIELD

The present invention relates to a refrigerator oil composition. More precisely, it relates to a refrigerator oil composition of good lubricity, which is especially effective for reducing the friction and abrasion in both the oil region and the extreme-pressure region in the sliding area between aluminium materials and steel materials and which is favorable to lubricating oil for refrigerators using non-chlorine Flon refrigerants such as R134a and the like that do not bring about environmental pollution.

BACKGROUND ART

In general, a compressor-type refrigerator comprises at least a compressor, a condenser, an expansion mechanism (expansion valve, etc.), an evaporator and a drier, and a mixed liquid comprising a refrigerant and a lubricating oil is circulated in the closed system of the refrigerator. In the compressor-type refrigerator of that type, in general, dichlorodifluoromethane (R12), chlorodifluoromethane (R22) and the like have heretofore been used as refrigerants and various mineral oils and synthetic oils as lubricating oils.

However, since R12 and R22 will bring about environmental pollution, as destroying the ozone layer existing in the stratosphere, their use is being severely controlled in all the world. Given the situation, new refrigerants, non-chlorine Flon compounds such as hydrofluorocarbons have become specifically noted. Since such non-chlorine Flon compounds, for example, hydrofluorocarbons such as typically R134a will not destroy the ozone layer and can be substituted for R12 and the like without almost changing or modifying the structure of conventional refrigerators, they are favorable for refrigerants for compressor-type refrigerators.

The properties of these new Flon-substituent refrigerants are different from those of conventional Flon refrigerants; and it is known that refrigerator oils capable of being used along with these comprise a base oil component selected from, for example, polyalkylene glycols, polyesters, polyol esters, polycarbonates, polyvinyl ethers and alkylbenzenes having particular structures, and various additives added to the base oil component.

However, these refrigerator oils are seriously problematic in practical use in that, when used in the atmosphere comprising any of the above-mentioned refrigerants, their lubricity is poor and, in particular, they cause increased abrasion loss between aluminium materials and steel materials constituting compressors for air-conditioning refrigerators. Rotary-type, scroll-type and reciprocation-type compressors are used for air-conditioning refrigerators, and they have sliding members of a combination of aluminium materials and steel materials. In rotary-type compressors, for example, the bearing is the sliding member; in scroll-type compressors, the Oldham's coupling ring is the member; and in reciprocation-type compressors, the con'rod (aluminium)/piston pin (steel) member is the member. Regarding their condition for lubrication, the bearing and the Oldham's coupling ring act in an area which shall bear relatively low stress and in which the lubricating oil used exhibits its oily effect (this area is hereinafter referred to as an oil region); while the con'rod/piston pin member acts in an area which shall bear relatively high stress and which therefore requires the extreme-pressure effect of the lubricating oil used therein (this area is hereinafter referred to as an extreme-pressure region). In that situation, desired are refrigerator oils usable in any and every type of compressors, to which, therefore, desired are additives effective for reducing friction and abrasion in both regions, the oil region and extreme-pressure region.

For lubricity improvers for refrigerator oils, heretofore known are orthophosphates such as tricresyl phosphate (hereinafter referred to as TCP), triphenyl phosphate (hereinafter referred to as TPP), etc. These additives are effective for sliding members of a combination of steel materials and steel materials, but are not for those of a combination of steel materials and aluminium materials since they do not have the ability to reduce friction in the extreme-pressure region. Therefore, for ensuring good lubricity around them, the steel-aluminium sliding members require extreme-pressure agents substitutable for the conventional lubricity-improving additives.

On the other hand, another lubricity improver, sorbitan mono-oleate is proposed. This is effective for reducing friction in the oil region, but is problematic in that its volume resistivity is low.

The present invention has been made from the viewpoint as above, and its object is to provide a refrigerator oil composition of good lubricity, which is especially effective for reducing the friction in both the oil region and the extreme-pressure region in the sliding area between aluminium materials and steel materials and which is favorable to lubricating oil for refrigerators using non-chlorine Flon refrigerants such as R134a and the like that do not bring about environmental pollution.

DISCLOSURE OF THE INVENTION

We, the present inventors have assiduously studied so as to attain the object as above, and, as a result, have found that the object of the invention can be effectively attained by using specific additives. On the basis of this finding, we have completed the present invention.

The invention includes a first aspect and a second aspect, as described below.

The first aspect of the invention is summarized as follows:

(1) A refrigerator oil composition comprising a base oil of a mineral oil and/or a synthetic oil, and containing, based on the total amount of the composition, (a) from 0.01 to 5% by weight of a partial ester of a polyalcohol and a fatty acid, and (b) from 0.001 to 1% by weight of an acid phosphate or its amine salt.

(2) The refrigerator oil composition of above (1), wherein the component (a) is a partial ester of a tri- or tetra-alcohol and a fatty acid having from 12 to 24 carbon atoms.

(3) The refrigerator oil composition of above (1) or (2), wherein the base oil is an oxygen-containing synthetic oil.

(4) The refrigerator oil composition of above (3), wherein the oxygen-containing synthetic oil is at least one selected from polyvinyl ethers, polyol esters and polyalkylene glycols.

(5) The refrigerator oil composition of above (4), wherein the polyvinyl ethers are polyvinyl ether copolymers having constitutive units (A) of the following general formula (XIX):

(XIX)

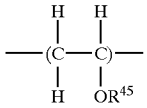

wherein $R^{45}$ represents a hydrocarbon group having from 1 to 3 carbon atoms and having or not having an ether bond in the molecule, and constitutive units (B) of the following general formula (XX):

(XX)

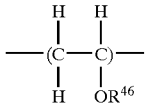

wherein $R^{45}$ represents a hydrocarbon group having from 3 to carbon atoms and having or not having an ether bond in the molecule, in which, however, $R^{45}$ in the constitutive units (A) is not the same as $R^{46}$ in the constitutive units (B).

(6) The refrigerator oil composition of above (5), wherein $R^{45}$ in the constitutive units (A) is an ethyl group, and $R^{46}$ in the constitutive units (B) is an isobutyl group.

The second aspect of the invention is summarized as follows:

(1) A refrigerator oil composition comprising a base oil of a mineral oil and/or a synthetic oil, and containing at least one compound selected from the group consisting of (a) acid phosphates or their amine salts, (b) acetylene glycol alkylene oxide adducts, (c) potassium or sodium salts of fatty acids, (d) organic acids of the following general formula (XXXIV):

(XXXIV)

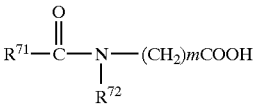

wherein $R^{71}$ represents an alkyl group having from 6 to 30 carbon atoms, or an alkenyl group having from 6 to 30 carbon atoms; $R^{72}$ represents an alkyl group having from 1 to 4 carbon atoms; and m indicates an integer of from 1 to 4, and (e) fatty acid amides.

(2) The refrigerator oil composition of above (1), wherein the amount of the component (a) falls between 0.001 and 1% by weight based on the total amount of the composition.

(3) The refrigerator oil composition of above (1) or (2), wherein the amount of the component (b), that of the component (c), that of the component (d) and that of the component (e) each fall between 0.01 and 5% by weight based on the total amount of the composition.

(4) The refrigerator oil composition of any of above (1) to (3), wherein the base oil is an oxygen-containing synthetic oil.

(5) The refrigerator oil composition of above (4), wherein the oxygen-containing synthetic oil is at least one selected from polyvinyl ethers, polyol esters and polyalkylene glycols.

(6) The refrigerator oil composition of above (5), wherein the polyvinyl ethers are polyvinyl ether copolymers having constitutive units (A) of the following general formula (XIX);

(XIX)

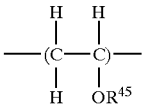

wherein $R^{45}$ represents a hydrocarbon group having from 1 to 3 carbon atoms and having or not having an ether bond in the molecule, and constitutive units (B) of the following general formula (XX):

(XX)

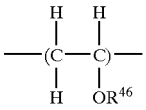

wherein $R^{46}$ represents a hydrocarbon group having from 3 to 20 carbon atoms and having or not having an ether bond in the molecule, in which, however, $R^{45}$ in the constitutive units (A) is not the same as $R^{46}$ in the constitutive units (B).

(7) The refrigerator oil composition of above (6), wherein $R^{45}$ in the constitutive units (A) is an ethyl group, and $R^{46}$ in the constitutive units (B) is an isobutyl group.

BEST MODES OF CARRYING OUT THE INVENTION

Embodiments of the first and second aspects of the invention are described below.

[First Aspect of the Invention]

In this section, the first aspect of the invention will be simply referred to as "the invention".

In the refrigerator oil composition of the invention, the base oil is a mineral oil and/or a synthetic oil. Not specifically defined, the mineral oil and the synthetic oil may be any ones generally used for the base oil of ordinary refrigerator oil. Preferably, they have a kinematic viscosity at 40° C. of from 2 to 500 $mm^2$/sec, more preferably from 5 to 200 $mm^2$/sec, even more preferably from 10 to 100 $mm^2$/sec. Their pour point that indicates the low-temperature flowability of the base oil is preferably not higher than −10° C.

Various types of such mineral oils and synthetic oils are known, and the base oil to be in the refrigerator oil composition of the invention may be suitably selected from them, depending on the use of the composition. For example, the mineral oils include paraffinic mineral oils, naphthenic mineral oils, and intermediate base mineral oils. The synthetic oils include oxygen-containing synthetic oils and hydrocarbon-type synthetic oils.

The oxygen-containing synthetic oils include those having any of ether groups, ketone groups, ester groups, carbonate groups and hydroxyl groups in the molecule, and those additionally having hetero atoms (e.g., S, P, F, Cl, Si, N) in addition to such groups. Concretely, they are <1> polyvinyl ethers, <2> polyol esters, <3> polyalkylene glycols, <4> polyesters, <5> carbonate derivatives, <6> polyether ketones, <7> fluorinated oils, etc.

The oxygen-containing synthetic oils are described in detail in the last part of this section.

The hydrocarbon-type synthetic oils are, for example, olefinic polymers such as poly-α-olefins, and alkylbenzenes, alkylnaphthalenes, etc.

The refrigerator oil composition of the invention may comprise, as the base oil, one or more of the above-mentioned mineral oils either singly or as combined, or one or more of the above-mentioned synthetic oils either singly or as combined, or even one or more such mineral oils and one or more such synthetic oils as combined. For the base oil, synthetic oils are preferred to mineral oils, and oxygen-containing synthetic oils are more preferred as well compatible with Flon refrigerants such as R-134a and having good lubricating properties. Of those, even more preferred are polyvinyl ethers, polyol esters and polyalkylene glycols.

The component (a) and the component (b) to be incorporated into the base oil are described.

Component (a)

The component (a) to be in the refrigerator oil composition of the invention is a partial ester of a polyalcohol and a fatty acid, and is preferably a partial ester of a tri- or tetra-alcohol and a fatty acid having from 12 to 24 carbon atoms in view of its ability to reduce friction and of its volume resistivity.

Concretely, the tri- or tetra-alcohol includes trimethylolethane, trimethylolpropane, glycerin, erythritol, pentaerythritol. Of those, preferred are glycerin, trimethylolpropane and trimethylolethane; and more preferred is glycerin.

The fatty acid having from 12 to 24 carbon atoms may be linear or branched, and may be saturated or unsaturated. Concretely, the linear saturated fatty acid includes lauric acid, tridecylic acid, myristic acid, pentadecylic acid, palmitic acid, margaric acid, stearic acid, nonadecylic acid, arachic acid, behenic acid, lignoceric acid, etc. Concretely, the linear unsaturated fatty acid includes linderic acid, 5-lauroleic acid, tuduric acid, myristoleic acid, zoomaric acid, petroceric acid, oleic acid, elaidic acid, eicosenoic acid, erucic acid, selacholeic acid, etc.

Concretely, the branched saturated fatty acid includes all isomers of methylundecanoic acid, all isomers of propylnonanoic acid, all isomers of methyldodecanoic acid, all isomers of propyldecanoic acid, all isomers of methyltridecanoic acid, all isomers of methyltetradecanoic acid, all isomers of methylpentadecanoic acid, all isomers of ethyltetradecanoic acid, all isomers of methylhexadecanoic acid, all isomers of propyltetradecanoic acid, all isomers of ethylhexadecanoic acid, all isomers of methylheptadecanoic acid, all isomers of butyltetradecanoic acid, all isomers of methyloctadecanoic acid, all isomers of ethyloctadecanoic acid, all isomers of methylnonadecanoic acid, all isomers of ethyloctadecanoic acid, all isomers of methyleicosanoic acid, all isomers of propyloctadecanoic acid, all isomers of butyloctadecanoic acid, all isomers of methyldocosanoic acid, all isomers of pentyloctadecanoic acid, all isomers of methyltricosanoic acid, all isomers of ethyldocosanoic acid, all isomers of propylhexaeicosanoic acid, all isomers of hexyloctadecanoic acid, 4,4-dimethyldecanoic acid, 2-ethyl-3-methylnonanoic acid, 2,2-dimethyl-4-ethyloctanoic acid, 2-propyl-3-methylnonanoic acid, 2,3-dimethyldodecanoic acid, 2-butyl-3-methylnonanoic acid, 3,7,11-trimethyldodecanoic acid, 4,4-dimethyltetradecanoic acid, 2-butyl-2-pentylheptanoic acid, 2,3-dimethyltetradecanoic acid, 4,8,12-trimethyltridecanoic acid, 14,14-dimethylpentadecanoic acid, 3-methyl-2-heptylnonanoic acid, 2,2-dipentylhetanoic acid, 2,2-dimethylhexadecanoic acid, 2-octyl-3-methylnonanoic acid, 2,3-dimethylheptadecanoic acid, 2,4-dimethylocatadecanoic acid, 2-butyl-2-heptylnonanoic acid, 20,20-dimethylheneicosanoic acid, etc.

The branched unsaturated fatty acid includes 5-methyl-2-undecenoic acid, 2-methyl-2-dodecenoic acid, 5-methyl-2-tridecenoic acid, 2-methyl-9-octadecenoic acid, 2-ethyl-9-octadecenoic acid, 2-propyl-9-octadecenoic acid, 2-methyl-2-eicosenoic acid, etc. Of the fatty acids having from 12 to 24 carbon atoms mentioned above, preferred are stearic acid, oleic acid, 16-methylheptadecanoic acid (isostearic acid), etc.

For the partial ester, preferred are monocarboxylates, dicarboxylates or their mixtures.

Concretely, preferred examples of the polyalcohol/fatty acid partial ester are glycerin mono-oleate, glycerin dioleate, glycerin monostearate, glycerin distearate, glycerin monoisostearate, glycerin diisostearate, etc.

For the component (a), one or more compounds mentioned above may be used either singly or as combined.

The amount of the component (a) to be in the composition falls between 0.01 and 5% by weight based on the total amount of the composition. If it is too small, the object of the invention could not be sufficiently attained; and even if too large, it will not produce better results, and if too large, the solubility of the component (a) in the base oil rather lowers. Preferably, the amount of the component (a) falls between 0.1 and 2% by weight.

Component (b)

The acid phosphate for the component (b) in the refrigerator oil composition of the invention includes orthophosphates of the following general formula (I) or (II):

(I)

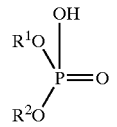

(II)

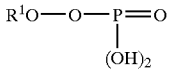

wherein $R^1$ and $R^2$ each represent an alkyl, alkenyl, alkylaryl or arylalkyl group having from 4 to 30 carbon atoms, and they may be the same or different, and phosphites of the following general formula (III):

(III)

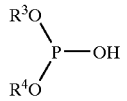

wherein $R^3$ and $R^4$ each represent an alkyl, alkenyl, alkylaryl or arylalkyl group having from 4 to 30 carbon atoms, and they may be the same or different.

The orthophosphate is a mixture of the diester of formula (I) and the monoester of formula (II). Concretely, it includes, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, isostearyl acid phosphate, oleyl acid phosphate, etc.

Concretely, the phosphite includes, for example, dibutyl hydrogenphosphite, dilauryl hydrogenphosphite, dioleyl hydrogenphosphite, distearyl hydrogenphosphite, diphenyl hydrogenphosphite, etc.

Of the acid phosphates mentioned above, for example, preferred are 2-ethylhexyl acid phosphate, stearyl acid phosphate, oleyl acid phosphate, etc.

Amines that form amine salts with them include, for example, mono-substituted amines, di-substituted amines and tri-substituted amines of the following general formula (IV):

$$R_nNH_{3-n} \quad \text{(IV)}$$

wherein R represents an alkyl or alkenyl group having from 3 to 30 carbon atoms, an aryl or arylalkyl group having from 6 to 30 carbon atoms, or a hydroxyalkyl group having from 2 to 30 carbon atoms; n indicates 1, 2 or 3; and plural R's, if any, may be the same or different.

The alkyl or alkenyl group having from 3 to 30 carbon atoms for R in formula (IV) may be linear, branched or cyclic.

Examples of the mono-substituted amines are butylamine, pentylamine, hexylamine, cyclohexylamine, octylamine, laurylamine, stearylamine, oleylamine, benzylamine, monoethanolamine, monopropanolamine, etc.; and those of the di-substituted amines are dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonoethanolamine, benzylmonoethanolamine, phenylmonoethanolamine, tolylmonopropanolamine, etc. Examples of the tri-substituted amines are tributylamine, tripentylamine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipropanolamine, xylyldiethanolamine, triethanolamine, tripropanolamine, etc.

For the component (b), one or more compounds mentioned above may be used either singly or as combined.

The amount of the component (b) to be in the composition falls between 0.001 and 1% by weight based on the total amount of the composition. If it is too small, the object of the invention could not be sufficiently attained; and even if too large, it will not produce better results, and if too large, the solubility of the component (b) in the base oil rather lowers. Preferably, the amount of the component (b) falls between 0.003 and 0.05% by weight.

The refrigerator oil composition of the invention may optionally contain, if desired, various known additives, for example, extreme pressure agents such as tricresyl phosphate, etc.; phenolic or amine-based antioxidants; acid-trapping agents such as epoxy compounds, e.g., phenyl glycidyl ether, cyclohexene-oxide, epoxidated soybean oil, etc.; copper-inactivating agents such as benzotriazole, benzotriazole derivatives, etc.; and defoaming agents such as silicone oils, fluorosilicone oils, etc.

The refrigerants to be used in refrigerators to which the refrigerator oil composition of the present invention is applied are, for example, hydrofluorocarbons, fluorocarbons, hydrocarbons, ethers, carbon dioxide-containing refrigerants, and ammonia-containing refrigerants. Of those, preferred are hydrofluorocarbons. Preferred examples of hydrofluorocarbons are 1,1,1,2-tetrafluoroethane (R134a), difluoromethane (R32), pentafluoroethane (R125) and 1,1,1-trifluouroethane (R143a). One or more of these may be used either singly or as combined. These hydrofluorocarbons are preferred for refrigerants for compression refrigerators, as there is no possibility of their destroying the ozone layer. Examples of mixed refrigerants to which the oil composition of the invention is also applicable are a mixture of R32, R125 and R134a in a ratio by weight of 23:25:52 (hereinafter referred to as R407C); a mixture thereof in a ratio by weight of 25:15:60; a mixture of R32 and R125 in a ratio by weight of 50:50 (hereinafter referred to as R410A); a mixture of R32 and R125 in a ratio by weight of 45:55 (hereinafter referred to as R410B); a mixture of R125, R143a and R134a in a ratio by weight of 44:52:4 (hereinafter referred to as R404A); a mixture of R125 and R143a in a ratio by weight of 50:50 (hereinafter referred to as R507), etc.

Last described are the oxygen-containing synthetic oil that serve as the base oil herein.

The polyvinyl ethers <1> mentioned above include, for example, polyvinyl ether compounds (1) having constitutive units of the following general formula (V):

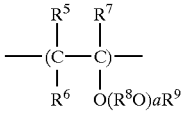

(V)

wherein $R^5$ to $R^7$ each represent a hydrogen atom, or a hydrocarbon group having from 1 to 8 carbon atoms, and they may be the same or different; $R^1$ represents a divalent hydrocarbon group having from 1 to 10 carbon atoms, or a divalent, ether bond oxygen-containing hydrocarbon group having from 2 to 20 carbon atoms; $R^9$ represents a hydrocarbon group having from 1 to 20 carbon atoms; a represents a number of from 0 to 10 on average; $R^5$ to $R^9$ may be the same or different in different constitutive units; and plural $R^8O$'s, if any, may be the same or different.

Also usable herein are polyvinyl ether compounds (2) of block or random copolymers having constitutive units of formula (V) noted above and constitutive units of the following general formula (VI):

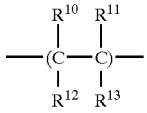

(VI)

wherein $R^{10}$ to $R^{13}$ each represent a hydrogen atom, or a hydrocarbon group having from 1 to 20 carbon atoms, and they may be the same or different; and $R^{10}$ to $R^{13}$ may be the same or different in different constitutive units.

Further usable herein are polyvinyl ether compounds (3) that are mixtures of the above-mentioned polyvinyl ether compounds (1) and polyvinyl ether compounds (2).

In formula (V), $R^5$ to $R^7$ each represent a hydrogen atom, or a hydrocarbon group having from 1 to 8 carbon atoms, preferably from 1 to 4 carbon atoms. Concretely, the hydrocarbon group indicates, for example, an alkyl group including a methyl group, an ethyl group, an n-propyl group, an isopropyl group, all types of butyl group, all types of pentyl group, all types of hexyl group, all types of heptyl group, all types of octyl group; a cycloalkyl group including a cyclopentyl group, a cyclohexyl group, all types of methylcyclohexyl group, all types of ethylcyclohexyl group, all types of dimethylcyclohexyl group, etc.; an aryl group including a phenyl group, all types of methylphenyl group, all types of ethylphenyl group, all types of dimethylphenyl group; or an arylalkyl group including a benzyl group, all types of phenylethyl group, all types of methylbenzyl group. Especially preferably, $R^5$ to $R^7$ are hydrogen atoms.

In formula (V), $R^8$ represents a divalent hydrocarbon group having from 1 to 10 carbon atoms, preferably from 2 to 10 carbon atoms, or a divalent, ether bond oxygen-containing hydrocarbon group having from 2 to 20 carbon atoms. Concretely, the divalent hydrocarbon group having from 1 to 10 carbon atoms indicates, for example, a divalent aliphatic group including a methylene group, an ethylene group, a phenylethylene group, a 1,2-propylene group, a 2-phenyl-1,2-propylene group, a 1,3-propylene group, all types of butylene group, all types of pentylene group, all types of hexylene group, all types of heptylene group, all types of octylene group, all types of nonylene group, all types of decylene group; an alicyclic group with two bonding sites to be derived from an alicyclic hydrocarbon which includes cyclohexane, methylcyclohexane, ethylcyclohexane, dimethylcyclohexane, propylcyclohexane, etc.; a divalent aromatic hydrocarbon group including all types of phenylene group, all types of methylphenylene group, all types of ethylphenylene group, all types of dimethylphenylene group, all types of naphthylene group, etc.; an alkylaromatic group to be derived from an alkylaromatic hydrocarbon such as toluene, xylene, ethylbenzene or the like, and having a monovalent bonding site both in the alkyl moiety and in the aromatic moiety therein; or an alkylaromatic group to be derived from a polyalkylaromatic hydrocarbon such as xylene, diethylbenzene or the like, and having bonding sites in the alkyl moieties therein. Of those, especially preferred are aliphatic groups each having from 2 to 4 carbon atoms.

Examples of the divalent, ether bond oxygen-containing hydrocarbon group having from 2 to 20 carbon atoms are a methoxymethylene group, a methoxyethylene group, a methoxymethylethylene group, a 1,1-bismethoxymethylethylene group, a 1,2-bismethoxymethylethylene group, an ethoxymethylethylene group, a (2-methoxyethoxy)methylethylene group, a (1-methyl-2-methoxy)methylethylene group, etc. in formula (V), a indicates the number of the repetitive $R^{10}$ therein, and falls between 0 and 10 on average, preferably between 0 and 5. Plural $R^8O$'s, if any in formula (V), may be the same or different.

In formula (V), $R^9$ represents a hydrocarbon group having from 1 to 20, preferably from 1 to 10 carbon atoms. Concretely, the hydrocarbon group indicates, for example, an alkyl group including a methyl group, an ethyl group, an n-propyl group, an isopropyl group, all types of butyl group, all types of pentyl group, all types of hexyl group, all types of heptyl group, all types of octyl group, all types of nonyl group, all types of decyl group; a cycloalkyl group including a cyclopentyl group, a cyclohexyl group, all types of methylcyclohexyl group, all types of ethylcyclohexyl group, all types of propylcyclohexyl group, all types of dimethylcyclohexyl group, etc.; an aryl group including a phenyl group, all types of methylphenyl group, all types of ethylphenyl group, all types of dimethylphenyl group, all types of propylphenyl group, all types of trimethylphenyl group, all types of butylphenyl group, all types of naphthyl group, etc.; or an arylalkyl group including a benzyl group, all types of phenylethyl group, all types of methylbenzyl group, all types of phenylpropyl group, all types of phenylbutyl group, etc.

The polyvinyl ether compounds (1) have the constitutive units of formula (V), in which the number of the repetitive units (that is, the degree of polymerization of the compounds) may be suitably selected depending on the desired kinematic viscosity of the compounds. In the polyvinyl ether compounds, the ratio by mol of carbon/oxygen preferably falls between 3.5 and 7.0. If the molar ratio is smaller than 3.5, the moisture absorption of the compounds will be high; but if larger than 70, the compatibility of the compounds with refrigerants will be poor.

The polyvinyl ether compounds (2) are block or random copolymer having the constitutive units of formula (V) and the constitutive units of formula (VI). In formula (VI), $R^{10}$ to $R^{13}$ each represent a hydrogen atom, or a hydrocarbon group having from 1 to 20 carbon atoms, and they may be the same or different. For examples of the hydrocarbon group having from 1 to 20 carbon atoms, referred to are the same as those mentioned hereinabove for $R^9$ in formula (V). $R^{10}$ to $R^{13}$ may be the same or different in different constitutive units.

The degree of polymerization of the polyvinyl ether compounds (2) of block or random copolymers having the constitutive units of formula (V) and the constitutive units of formula (VI) may be suitably determined, depending on the desired kinematic viscosity of the compounds. In the polyvinyl ether compounds, the ratio by mol of carbon/oxygen preferably falls between 3.5 and 7.0. If the molar ratio is smaller than 3.5, the moisture absorption of the compounds will be high; but if larger than 7.0, the compatibility of the compounds with refrigerants will be poor.

The polyvinyl ether compounds (3) are mixtures of the above-mentioned polyvinyl ether compounds (1) and (2), in which the blend ratio of the compounds (1) and (2) is not specifically defined.

The polyvinyl ether compounds (1) and (2) for use in the invention may be produced through polymerization of vinyl ether monomers corresponding thereto, or through copolymerization of hydrocarbon monomers having an olefinic double bond and corresponding thereto with vinyl ether monomers also corresponding thereto. The vinyl ether monomers may be represented by the following general formula (VII):

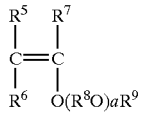

(VII)

wherein $R^5$ to $R^9$ and a have the same meanings as above.

Corresponding to the above-mentioned polyvinyl ether compounds (1) and (2), the vinyl ether monomers include various compounds, for example, vinyl methyl ether, vinyl ethyl ether, vinyl n-propyl ether, vinyl isopropyl ether, vinyl n-butyl ether, vinyl isobutyl ether, vinyl sec-butyl ether, vinyl tert-butyl ether, vinyl n-pentyl ether, vinyl n-hexyl ether, vinyl 2-methoxyethyl ether, vinyl 2-ethoxyethyl ether, vinyl 2-methoxy-1-methylethyl ether, vinyl 2-methoxy-2-methyl ether, vinyl 3,6-dioxaheptyl ether, vinyl 3,3,6-trioxadecyl ether, vinyl 1,4-dimethyl-3,6-dioxaheptyl ether, vinyl 1,4,7-trimethyl-3,6,9-trioxadeyl ether, vinyl-2,6-dioxa-4-heptyl ether, vinyl 2,6,9-trioxa-4-decyl ether, 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene, 2-tert-butoxypropene, 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene, 2-tert-butoxy-2-butene, etc.

These vinyl ether monomers may be produced in any known methods.

The olefinic double bond-having hydrocarbon monomers may be represented by the following general formula (VIII):

(VIII)

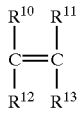

wherein $R^{10}$ to $R^{13}$ have the same meanings as above.

The monomers include, for example, ethylene, propylene all isomers of butene, all isomers of pentene, all isomers of hexene, all isomers of heptene, all isomers of octene, diisobutylene, triisobutylene, styrene, all isomers of alkyl-substituted styrenes, etc.

Preferably, the polyvinyl ether compounds for use in the invention are specifically terminated in the manner mentioned below. In one preferred example of the terminal structure of the compounds, one end of the molecule is terminated with a group of the following general formula (IX) or (X):

(IX)

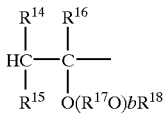

(X)

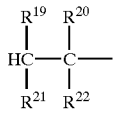

wherein $R^{14}$ to $R^{16}$ each represent a hydrogen atom, or a hydrocarbon group having from 1 to 8 carbon atoms, and they may be the same or different; $R^{19}$ to $R^{22}$ each represent a hydrogen atom, or a hydrocarbon group having from 1 to 20 carbon atoms, and they may be the same or different; $R^{17}$ represents a divalent hydrocarbon group having from 1 to 10 carbon atoms, or a divalent, ether bond oxygen-containing hydrocarbon group having from 2 to 20 carbon atoms; $R^{18}$ represents a hydrocarbon group having from 1 to 20 carbon atoms; b indicates a number of from 0 to 10 on average; and plural $R^{17}O$'s, if any, may be the same or different, and the other end thereof is terminated with a group of the following general formula (XI) or (XII):

(XI)

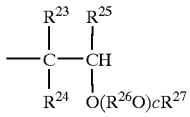

(XII)

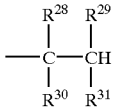

wherein $R^{23}$ to $R^{25}$ each represent a hydrogen atom, or a hydrocarbon group having from 1 to 8 carbon atoms, and they may be the same or different; $R^{28}$ to $R^{3'}$ each represent a hydrogen atom, or a hydrocarbon group having from 1 to 20 carbon atoms, and they may be the same or different; $R^{26}$ represents a divalent hydrocarbon group having from 1 to 10 carbon atoms, or a divalent, ether bond oxygen-containing hydrocarbon group having from 2 to 20 carbon atoms; $R^{2}1$ represents a hydrocarbon group having from 1 to 20 carbon atoms; c indicates a number of from 0 to 10 on average; and plural $R^{26}O$'s, if any, may be the same or different.

In another preferred example of the terminal structure of the compounds, one end of the molecule is terminated with a group of formula (IX) or (X) as above and the other end thereof is terminated with a group of the following general formula (XIII):

(XIII)

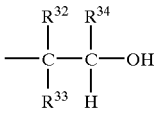

wherein $R^{32}$ to $R^{14}$ each represent a hydrogen atom, or a hydrocarbon group having from 1 to 8 carbon atoms, and they may be the same or different.

Of those polyvinyl ether compounds, the following are especially favorable for the base oil in the refrigerator oil composition of the invention.

(1) Compounds comprising constitutive units of formula (V) and terminated with a group of formula (IX) or (X) at one end and with a group of formula (XI) or (XII) at the other end, in which $R^1$ to $R^7$ in the units of formula (V) are all hydrogen atoms, a is a number of from 0 to 4, $R^8$ is a divalent hydrocarbon group having from 2 to 4 carbon atoms, and $R^9$ is a hydrocarbon group having from 1 to 20 carbon atoms.

(2) Compounds composed of constitutive units of formula (V) only and terminated with a group of formula (IX) at one end and with a group of formula (XI) at the other end, in which $R^5$ to $R^7$ in the units of formula (V) are all hydrogen atoms, a is a number of from 0 to 4, $R^8$ is a divalent hydrocarbon group having from 2 to 4 carbon atoms, and $R^9$ is a hydrocarbon group having from 1 to 20 carbon atoms.

(3) Compounds comprising constitutive units of formula (V) and terminated with a group of formula (IX) or (X) at one end and with a group of formula (XIII) at the other end, in which $R^5$ to $R^7$ in the units of formula (V) are all hydrogen atoms, a is a number of from 0 to 4, $R^8$ is a divalent hydrocarbon group having from 2 to 4 carbon atoms, and $R^9$ is a hydrocarbon group having from 1 to 20 carbon atoms.

(4) Compounds composed of constitutive units of formula (V) only and terminated with a group of formula (IX) at one end and with a group of formula (XII) at the other end, in which $R^5$ to $R^7$ in the units of formula (V) are all hydrogen atoms, a is a number of from 0 to 4, $R^8$ is a divalent hydrocarbon group having from 2 to 4 carbon atoms, and $R^9$ is a hydrocarbon group having from 1 to 20 carbon atoms.

In the invention, also usable are polyvinyl ether compounds comprising the constitutive units of formula (V) and terminated with a group of formula (IX) noted above at one end and with a group of the following general formula (XIV) at the other end:

(XIV)

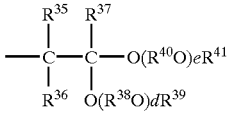

wherein $R^{35}$ to $R^{37}$ each represent a hydrogen atom, or a hydrocarbon group having from 1 to 8 carbon atoms, and they may be the same or different; $R^{38}$ and $R^{40}$ each represent a divalent hydrocarbon group having from 2 to 10 carbon atoms, and they may be the same or different; $R^{39}$ and $R^{41}$ each represent a hydrocarbon group having from 1 to 10 carbon atoms, and they may be the same or different; d and e each represent a number of from 0 to 10 on average, and they maybe the same or different; plural $R^{38}O$'s, if any, may be the same or different, and plural $R^{40}O$'s, if any, may also be the same or different.

Further usable herein are polyvinyl ether compounds of homopolymers or copolymers of alkyl vinyl ethers, which comprise constitutive units of the following general formula (XV) or (XVI):

(XV)

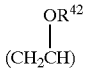

(XVI)

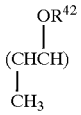

wherein $R^{42}$ represents a hydrocarbon group having from 1 to 8 carbon atoms, and have a weight-average molecular weight of from 300 to 3,000 (preferably from 300 to 2,000) and of which one end is terminated with a group of the following general formula (XVII) or (XVIII):

(XVII)

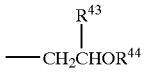

(XVIII)

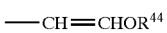

wherein $R^{43}$ represents an alkyl group having from 1 to 3 carbon atoms; and $R^{44}$ represents a hydrocarbon group having from 1 to 8 carbon atoms.

Especially preferred for use herein are polyvinyl ether copolymers having constitutive units (A) of the following general formula (XIX):

(XIX)

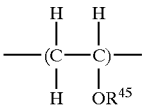

wherein $R^{45}$ represents a hydrocarbon group having from 1 to 3 carbon atoms, and having or not having an ether bond in the molecule, and constitutive units (B) of the following general formula (XX):

(XX)

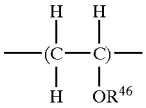

wherein $R^{46}$ represents a hydrocarbon group having from 3 to 20 carbon atoms, and having or not having an ether bond in the molecule, in which, however, $R^{45}$ in the constitutive units (A) is not the same as $R^{46}$ in the constitutive units (B).

In these, preferably, $R^{45}$ is an alkyl group having from 1 to 3 carbon atoms, and $R^{46}$ is an alkyl group having from 3 to 20 carbon atoms. More preferred are homopolymers in which $R^{45}$ is an ethyl group; and copolymers in which $R^{45}$ is a methyl or ethyl group, and $R^{46}$ is an alkyl group having from 3 to 6 carbon atoms. Most preferred are copolymers in which $R^{45}$ is an ethyl group, and $R^{46}$ is an isobutyl group. In these, the ratio of the constitutive units (A) to the constitutive units (B) preferably falls between 95:5 and 50:50 by mol, more preferably between 95:5 and 70:50. The copolymers may be random or block copolymers.

The polyvinyl ether compounds may be produced through radical polymerization, cationic polymerization or radiation polymerization of the monomers mentioned hereinabove. For example, the vinyl ether monomers may be polymerized in the manner mentioned below to give polymers having a desired viscosity.

To initiate the polymerization, employable is a combination of any of Brønsted acids, Lewis acids or organic metal compounds with any of water, alcohols, phenols, acetals or vinyl ether-carboxylic acid adducts.

The Brønsted acids include, for example, hydrofluoric acid, hydrochloric acid, hydrobromic acid, hydroiodic acid, nitric acid, sulfuric acid, trichloroacetic acid, trifluoroacetic acid, etc. The Lewis acids include, for example, boron trifluoride, aluminium trichloride, aluminium tribromide, tin tetrachloride, zinc dichloride, ferric chloride, etc. Of these Lewis acids, especially preferred is boron trifluoride. The organic metal compounds include, for example, aluminium diethylchloride, aluminium ethylchloride, diethylzinc, etc.

Any of water, alcohols, phenols, acetals or vinyl ether-carboxylic acid adducts may be selected and combined with any of the compounds mentioned above. The alcohols include, for example, saturated aliphatic alcohols having from 1 to 20 carbon atoms such as methanol, ethanol, propanol, isopropanol, butanol, isobutanol, sec-butanol, tert-butanol, all isomers of pentanol, all isomers of hexanol, all isomers of heptanol, all isomers of octanol, etc.; and unsaturated aliphatic alcohols having from 3 to 10 carbon atoms such as allyl alcohol, etc.

In the vinyl ether-carboxylic acid adducts, the carboxylic acid includes, for example, acetic acid, propionic acid, n-butyric acid, isobutyric acid, n-valeric acid, isovaleric acid, 2-methylbutyric acid, pivalic acid, n-caproic acid, 2,2-dimethylbutyric acid, 2-methylvaleric acid, 3-methylvaleric acid, 4-methylvaleric acid, enanthic acid, 2-methylcaproic acid, caprylic acid, 2-ethylcaproic acid, 2-n-propylvaleric acid, n-nonanoic acid, 3,5,5-trimethylcaproic acid, undecanoic acid, etc.

In the adducts, the vinyl ether may be the same as or different from that to be polymerized to give the intended polymers. To prepare the vinyl ether-carboxylic acid adducts, the two are mixed and reacted at a temperature falling between 0 and 100° C. or so. The product may be separated from the reaction mixture through distillation or the like and used in the polymerization of vinyl ether monomers, but may be directly used therein without being separated.

In case where any of water, alcohols or phenols is used in the polymerization, one end of the resulting polymers at which the polymerization was initiated is terminated with hydrogen. In case where an acetal is used, that one end is terminated with hydrogen or an acetal-derived group of which one alkoxy group has released from the used acetal. In case where a vinyl ether-carboxylic acid adduct is used, that one end is terminated with an alkylcarbonyloxy group derived from the carboxylic acid moiety of the vinyl ether-carboxylic acid adduct used.

On the other hand, the other end of the polymers at which the polymerization was terminated forms an acetal, olefin or aldehyde terminal when any of water, alcohols, phenols or acetals is used in the polymerization. However, when a vinyl ether-carboxylic acid adduct is used, it forms a hemiacetal carboxylate.

The terminals of the polymers thus produced may be converted into any desired groups in any known methods. The desired groups include, for example, residues of saturated hydrocarbons, ethers, alcohols, ketones, nitriles, amides, etc., but are preferably residues of saturated hydrocarbons, ethers or alcohols.

Though depending on the type of the starting material and the initiator used, the polymerization of the vinyl ether monomers of formula (VII) may be initiated at a temperature falling between −80 and 150° C., but in general, it is initiated at a temperature falling between −80 and 50° C. The polymerization finishes within 10 seconds to 10 hours or so after its start.

The molecular weight of the polymers to be produced through the polymerization as above may be controlled as follows. When the amount of any of water, alcohols, phenols, acetals or vinyl ether-carboxylic acid adducts to be in the polymerization system is increased relative to the amount of the vinyl ether monomer of formula (VII) to be polymerized, then the polymers produced may have a lowered mean molecular weight. In addition, when the amount of any of Brønsted acids or Lewis acids is increased, then the polymers produced may also have a lowered mean molecular weight.

The polymerization is effected generally in the presence of a solvent. The solvent is not specifically defined so far as it dissolves the necessary amount of the starting material and is inert to the reaction. Its preferred examples are hydrocarbons such as hexane, benzene, toluene, etc.; and ethers such as ethyl ether, 1,2-dimethoxyethane, tetrahydrofuran, etc. The polymerization may be stopped by adding an alkali to the system. After having been thus polymerized, the reaction mixture may be optionally subjected to ordinary separation and purification to thereby isolate the intended polyvinyl ether compound having constitutive units of formula (V).

As so mentioned hereinabove, the ratio of carbon/oxygen by mol in the polyvinyl ether compounds for use in the invention preferably falls between 3.5 and 7.0. For this, the molar ratio of carbon/oxygen of the starting monomers shall be so controlled that the molar ratio carbon/oxygen in the resulting polymer may fall within the preferred range; Concretely, when the ratio of the monomer having a larger carbon/oxygen molar ratio is larger, then the polymer produced has a larger carbon/oxygen molar ratio; but when the ratio of the monomer having a smaller carbon/oxygen molar ratio is larger, then the polymer produced has a smaller carbon/oxygen molar ratio.

The preferred molar ratio of the polymers may also be attained by controlling the combination of the initiator selected from water, alcohols, phenols, acetals and vinyl ether-carboxylic acid adducts, and the vinyl ether monomers to be polymerized as in the above-mentioned polymerization method for the monomers. Concretely, when the initiator is selected from alcohols and phenols having a larger carbon/oxygen molar ratio than the monomers to be polymerized, then the polymers produced have a larger carbon/oxygen molar ratio than the starting monomers; but when the initiator used is an alcohol such as methanol, methoxymethanol or the like having a smaller carbon/oxygen molar ratio, then the polymers produced have a smaller carbon/oxygen molar ratio than the starting monomers.

In case where vinyl ether monomers are copolymerized with olefinic double bond-having hydrocarbon monomers, the resulting polymers have a larger carbon/oxygen molar ratio than the starting vinyl ether monomers. In this case, the molar ratio of the polymers may be controlled by controlling the proportion of the olefinic double bond-having hydrocarbon monomers to be copolymerized and the number of carbon atoms constituting the monomers.

The polyol esters <2> are, for example, carboxylates of polyhydroxy compounds having at least 2 hydroxyl groups, such as those of the following general formula (XXI):

$$R^{47}[OCOR^{48}]_f \quad \text{(XXI)}$$

wherein $R^{47}$ represents a hydrocarbon group; $R^{48}$ represents a hydrogen atom, or a hydrocarbon group having from 1 to 22 carbon atoms; f indicates an integer of from 2 to 6; and the plural (—$OCOR^{48}$)'s may be the same or different.

In formula (XXI), $R^{47}$ represents a hydrocarbon group, which may be linear, branched or cyclic, and is preferably an alkyl group having from 2 to 10 carbon atoms. $R^{48}$ represents a hydrogen atom, or a hydrocarbon group having from 1 to 22 carbon atoms, and is preferably an alkyl group having from 2 to 16 carbon atoms.

The polyol esters of formula (XXI) can be obtained by reacting a polyalcohol of a general formula (XXII):

$$R^{47}[OH]_f \quad \text{(XXII)}$$

wherein $R^{47}$ and f have the same meanings as above, with a carboxylic acid or its reactive derivative such as ester or acid halide of a general formula (XXIII):

$$R^{49}COOH \quad \text{(XXIII)}$$

wherein $R^{48}$ has the same meaning as above.

The polyalcohol of formula (XXII) includes, for example, ethylene glycol, propylene glycol, butylene glycol, neopentyl glycol, trimethylolethane, trimethylolpropane, glycerin, pentaerythritol, dipentaerythritol, sorbitol, etc. The carboxylic acid of formula (XXIII) includes, for example, propionic acid, butyric acid, pivalic acid, valeric acid, caproic acid, heptanoic acid, 3-methylhexanoic acid, 2-ethylhexanoic acid, caprylic acid, pelargonic acid, capric acid, lauric acid, myristic acid, palmitic acid, etc.

The polyalkylene glycols <3> are, for example, compounds of the following general formula (XXIV):

$$R^{49}—[(OR^{50})_g—OR^{51}]_h \quad \text{(XXIV)}$$

wherein $R^{49}$ represents a hydrogen atom, an alkyl group having from 1 to 10 carbon atoms, an acyl group having from 2 to 10 carbon atoms, or an aliphatic hydrocarbon group having from 2 to 6 bonding sites and having from 1 to 10 carbon atoms; $R^{50}$ represents an alkylene group having from 2 to 4 carbon atoms; $R^{51}$ represents a hydrogen atom, an alkyl group having from 1 to 10 carbon atoms, or an acyl group having from 2 to 10 carbon atom; h indicates an integer of from 1 to 6; and g indicates a number to give a mean value of g×h falling between 6 and 80.

In formula (XXIV), the alkyl group for $R^{49}$ and $R^{51}$ may be linear, branched or cyclic. Examples of the alkyl group are a methyl group, an ethyl group, an n-propyl group, an isopropyl group, all types of butyl group, all types of pentyl group, all types of hexyl group, all types of heptyl group, all types of octyl group, all types of nonyl group, all types of decyl group, a cyclopentyl group, a cyclohexyl group, etc. If the number of carbon atoms constituting the alkyl group is larger than 10, the compatibility of the compounds with refrigerants will be poor, often causing phase separation. Preferably, the alkyl group has from 1 to 6 carbon atoms.

The alkyl moiety in the acyl group for $R^{49}$ and $R^{51}$ may be linear, branched or cyclic. For examples of the alkyl moiety in the acyl group, referred to are those with from 1 to 9 carbon atoms mentioned above for the alkyl group. If the number of carbon atoms constituting the acyl group is larger than 10, the compatibility of the compounds with refrigerants will be poor, often causing phase separation. Preferably, the acyl group has from 2 to 6 carbon atoms.

Where $R^{49}$ and $R^{51}$ are both alkyl groups or acyl groups, they may be the same or different.

Where h in formula (XXIV) is 2 or more, the plural $R^{51}$'s in one molecule may be the same or different.

Where $R^{49}$ is an aliphatic hydrocarbon group having from 2 to 6 bonding sites and having from 1 to 10 carbon atoms, the aliphatic hydrocarbon group may be linear or cyclic. Examples of the aliphatic hydrocarbon group having 2 bonding sites are an ethylene group, a propylene group, a butylene group, a pentylene group, a hexylene group, a heptylene group, an octylene group, a nonylene group, a decylene group, a cyclopentylene group, a cyclohexylene group, etc. Examples of the aliphatic hydrocarbon group having from 3 to 6 bonding sites are residues to be derived from polyalcohols such as trimethylolpropane, glycerin, pentaerythritol, sorbitol, 1,2,3-trihydroxycyclohexane and 1,3,5-trihydroxycyclohexane, by removing the hydroxyl groups from them.

If the number of carbon atoms constituting the aliphatic hydrocarbon group is larger than 10, the compatibility of the compounds with refrigerants will be poor, often causing phase separation. Preferably, the aliphatic hydrocarbon group has from 2 to 6 carbon atoms.

$R^{50}$ in formula (XXIV) is an alkylene group having from 2 to 4 carbon atoms. The oxyalkylene group for the repetitive units in formula (XXIV) includes an oxyethylene group, an oxypropylene group, and an oxybutylene group. The oxyalkylene groups in one molecule may be all the same or different ones. Preferably, however, one molecule of the compound contains at least an oxypropylene unit. More preferably, the oxypropylene unit content of the oxyalkylene groups in one molecule of the compound is at least 50 mol %. In case where the compound contains 2 or more oxyalkylene groups, it may be a random copolymer or a block copolymer.

In formula (XXIV), h is an integer of from 1 to 6, and shall be defined depending on the number of the bonding sites in $R^{49}$. For example, where $R^{49}$ is an alkyl group or an acyl group, h is 1; and where it is an aliphatic hydrocarbon group having 2, 3, 4, 5 or 6 bonding sites, his 2, 3, 4, 5 or 6, respectively. g is a number to give a mean value of g×h falling between 6 and 80. If the mean value of g×h oversteps the defined range, the object of the invention could not be attained satisfactorily.

Polyalkylene glycols of formula (XXIV) include those having a hydroxyl group at the terminal. Such hydroxyl-terminated compounds could be favorably used in the invention so far as the terminal hydroxyl content of the compounds is not larger than 50 mol % of the total terminal content thereof. If, however, the terminal hydroxyl content thereof is larger than 50 mol %, the moisture absorption of the compounds will increase and the viscosity index thereof will decrease.

For the polyalkylene glycols of formula (XXIV) for use herein, for example, preferred are polyoxypropylene glycol dimethyl ether, polyoxyethylene-polyoxypropylene glycol monomethyl ether, polyoxyethylene-polyoxypropylene glycol dimethyl ether, polyoxyethylene-polyoxypropylene glycol monobutyl ether, polyoxypropylene glycol monobutyl ether and polyoxypropylene glycol diacetate, in view of their economical aspects and their effects.

The polyesters <4> are, for example, aliphatic polyester derivatives having constitutive units of a general formula (XXV):

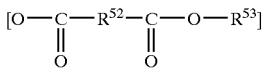

(XXV)

wherein $R^{52}$ represents an alkylene group having from 1 to 10 carbon atoms; and $R^{53}$ represents an alkylene group having from 2 to 10 carbon atoms, or an oxaalkylene group having from 4 to 20 carbon atoms, and having a molecular weight of from 300 to 2,000.

In formula (XXV), $R^{52}$ is an alkylene group having from 1 to 10 carbon atoms, which includes, for example, a methylene group, an ethylene group, a propylene group, an ethylmethylene group, a 1,1-dimethylethylene group, a 1,2-dimethylethylene group, an n-butylethylene group, an isobutylethylene group, a 1-ethyl-2-methylethylene group, a 1-ethyl-1-methylethylene group, a trimethylene group, a tetramethylene group, a pentamethylene group, etc. This is preferably an alkylene group having at most 6 carbon atoms. $R^{53}$ is an alkylene group having from 2 to 10 carbon atoms, or an oxaalkylene group having from 4 to 20 carbon atoms. The alkylene group may include those of $R^{52}$ referred to hereinabove (excepting a methylene group), but is preferably an alkylene group having from 2 to 6 carbon atoms. The oxaalkylene group includes, for example, a 3-oxa-1,5-pentylene group, a 3,6-dioxa-1,8-octylene group, a 3,6,9-trioxa-1,11-undecylene group, a 3-oxa-1,4-dimethyl-1,5-pentylene group, a 3,6-dioxa-1,4,7-trimethyl-1,8-octylene group, a 3,6,9-trioxa-1,4,7,10-tetramethyl-1,11-undecylene group, a 3-oxa-1,4-diethyl-1,5-pentylene group, a 3,6-dioxa-1,4,7-triethyl-1,8-octylene group, a 3,6,9-trioxa-1,4,7,10-tetraethyl-1,11-undecylene group, a 3-oxa-1,1,4,4-tetramethyl-1,5-pentylene group, a 3,6-dioxa-1,1,4,4,7,7-hexamethyl-1,8-octylene group, a 3,6,9-trioxa-1,1,4,4,7,7,10,10-octamethyl-1,11-undecylene group, a 3-oxa-1,2,4,5-tetramethyl-1,5-pentylene group, a 3,6-dioxa-1,2,4,5,7,8-hexamethyl-1,8-octylene group, a 3,6,9-trioxa-1,2,4,5,7,8,10,11-octamethyl-1,11-undecylene group, a 3-oxa-1-methyl-1,5-pentylene group, a 3-oxa-1-ethyl-1,5-pentylene group, a 3-oxa-1,2-dimethyl-1,5-pentylene group, a 3-oxa-1-methyl-4-ethyl-1,5-pentylene group, a 4-oxa-2,2,6,6-tetramethyl-1,7-heptylene group, a 4,8-dioxa-2,2,6,6,10,10-hexamethyl-1,11-undecylene group, etc. $R^{52}$ and $R^{53}$ may be the same or different in different constitutive units.

It is desirable that the aliphatic polyester derivatives of formula (XXV) have a molecular weight (measured through GPC) of from 300 to 2000. Those having a molecular weight of smaller than 300 and those having a molecular weight of larger than 2000 are both unfavorable to the base oil to be in refrigerator oil, since the kinematic viscosity of the former is too small and since the latter are waxy.

The polyesters mentioned above are described in detail in International Patent Laid-Open No. WO91/07479, and those described therein are all employable in the invention.

The carbonate derivatives <5> are, for example, polycarbonates of a general formula (XXVI)

$$R^{54}\underset{\underset{O}{\|}}{O}C\underset{\underset{O}{\|}}{O}[(R^{55}O)i-C]jR^{56} \quad \text{(XXVI)}$$

wherein $R^{54}$ and $R^{56}$ each represent a hydrocarbon group having at most 30 carbon atoms, or an ether bond-having hydrocarbon group having from 2 to 30 carbon atoms, and they may be the same or different; $R^{55}$ represents an alkylene group having from 2 to 24 carbon atoms; i indicates an integer of from 1 to 100; and j indicates an integer of from 1 to 10.

In formula (XXVI), $R^{54}$ and $R^{56}$ each are a hydrocarbon group having at most 30 carbon atoms, or an ether bond-having hydrocarbon group having from 2 to 30 carbon atoms. Examples of the hydrocarbon group having at most 30 carbon atoms are aliphatic hydrocarbon groups such as a methyl group, an ethyl group, an n-propyl group, an isopropyl group, all types of butyl group, all types of pentyl group, all types of hexyl group, all types of heptyl group, all types of octyl group, all types of nonyl group, all types of decyl group, all types of undecyl group, all types of dodecyl group, all types of tridecyl group, all types of tetradecyl group, all types of pentadecyl group, all types of hexadecyl group, all types of heptadecyl group, all types of octadecyl group, all types of nonadecyl group, all types of eicosyl group, etc.; alicyclic hydrocarbon groups such as a cyclohexyl group, a 1-cyclohexenyl group, a methylcyclohexyl group, a dimethylcyclohexyl group, a decahydronaphthyl group, a tricyclodecanyl group, etc.; aromatic hydrocarbon groups such as a phenyl group, all types of tolyl group, all types of xylyl group, a mesityl group, all types of naphthyl group, etc.; and aroaliphatic hydrocarbon groups such as a benzyl group, a methylbenzyl group, a phenylethyl group, a 1-methyl-1-phenylethyl group, a styryl group, a cinnamyl group, etc.

The ether bond-having hydrocarbon group having from 2 to 30 carbon atoms is, for example, a glycol ether group of a general formula (XXVII):

$$-(R^{57}-O)_k-R^{58} \quad \text{(XXVII)}$$

wherein $R^{57}$ represents an alkylene group having 2 or 3 carbon atoms (e.g., ethylene, propylene, or trimethylene); $R^{58}$ represents an aliphatic, alicyclic or aromatic hydrocarbon group having at most 28 carbon atoms (e.g., selected from those referred to hereinabove for $R^{54}$ and $R^{56}$); and k indicates an integer of from 1 to 20.

Concretely, it includes, for example, an ethylene glycol monomethyl ether group, an ethylene glycol monobutyl ether group, a diethylene glycol mono-n-butyl ether group, a triethylene glycol monoethyl ether group, a propylene glycol monomethyl ether group, a propylene glycol monobutyl ether group, a dipropylene glycol monoethyl ether group, a tripropylene glycol mono-n-butyl ether group, etc. Of those groups, preferred for $R^{54}$ and $R^{56}$ are alkyl groups such as an n-butyl group, an isobutyl group, an isoamyl group, a cyclohexyl group, an isoheptyl group, a 3-methylhexyl group, a 1,3-dimethylbutyl group, a hexyl group, an octyl group, a 2-ethylhexyl group, etc.; and alkylene glycol monoalkyl ether groups such as an ethylene glycol monomethyl ether group, an ethylene glycol monobutyl ether group, a diethylene glycol monomethyl ether group, a triethylene glycol monomethyl ether group, a propylene glycol monomethyl ether group, a propylene glycol monobutyl ether group, a dipropylene glycol monoethyl ether group, a tripropylene glycol mono-n-butyl ether group, etc.

In formula (XXVI), $R^{55}$ is an alkylene group having from 2 to 24 carbon atoms, which includes, for example, an ethylene group, a propylene group, a butylene group, an amylene group, a methylamylene group, an ethylamylene group, a hexylene group, a methylhexylene group, an ethylhexylene group, an octamethylene group, a nonamethylene group, a decamethylene group, a dodecamethylene group, a tetradecamethylene group, etc. In plural $R^{55}O$'s, if any, plural $R^{55}$'s may be the same or different.

The polycarbonates of formula (XXVI) preferably have a molecular weight (weight-average molecular weight) of from 300 to 3,000, more preferably from 400 to 1,500. Those having a molecular weight of smaller than 300 and those having a molecular weight of larger than 3,000 are both unsuitable for lubricating oil, since the kinematic viscosity of the former is too small and since the latter are waxy.

The polycarbonates can be produced in various methods, but, in general, they are produced from dicarbonates or carbonate-forming derivatives, such as phosgene or the like, and aliphatic dialcohols.

To produce the polycarbonates from them, employable are any ordinary methods for producing polycarbonates, but, in general, employed is any of interesterification or phosgenation.

The polycarbonates mentioned above are described in detail in Japanese Patent Laid-Open No. 217495/1991, and those described therein are all employable herein.

For the carbonate derivatives, also employable herein are glycol ether carbonates of a general formula (XXVIII):

$$R^{59}-O-(R^{61}O)_p-CO-(OR^{62})_q-O-R^{60} \quad \text{(XXVIII)}$$

wherein $R^{59}$ and $R^{60}$ each represent an aliphatic, alicyclic, aromatic or aroaliphatic hydrocarbon group having from 1 to 20 carbon atoms, and they may be the same or different; $R^{61}$ and $R^{62}$ each represent an ethylene group or an isopropylene group, and they may be the same or different; and p and q each indicate an integer of from 1 to 100.

In formula (XXVIII), examples of the aliphatic hydrocarbon group for $R^{59}$ and $R^{60}$ are a methyl group, an ethyl group, an n-propyl group, an isopropyl group, all types of butyl group, all types of pentyl group, all types of hexyl group, all types of heptyl group, all types of octyl group, all types of nonyl group, all types of decyl group, all types of undecyl group, all types of dodecyl group, all types of tridecyl group, all types of tetradecyl group, all types of pentadecyl group, all types of hexadecyl group, all types of heptadecyl group, all types of octadecyl group, all types of nonadecyl group, all types of eicosyl group, etc. Examples of the alicyclic hydrocarbon group are a cyclohexyl group, a 1-cyclohexenyl group, a methylcyclohexyl group, a dimethylcyclohexyl group, a decahydronaphthyl group, a tricyclodecanyl group, etc. Examples of the aromatic hydrocarbon group are a phenyl group, all types of tolyl group, all types of xylyl group, a mesityl group, all types of naphthyl group, etc. Examples of the aroaliphatic hydrocarbon group are a benzyl group, a methylbenzyl group, a phenylethyl group, a styryl group, a cinnamyl group, etc.

The glycol ether carbonates of formula (XXVIII) can be produced, for example, by interesterifying a polyalkylene glycol monoalkyl ether in the presence of an excess amount of an alcohol carbonate having a relatively low boiling point.

The glycol ether carbonates mentioned above are described in detail in Japanese Patent Laid-Open No. 149295/1991, and those described therein are all employable herein.

For the carbonate derivatives, further employable herein are carbonates of a general formula (XXIX):

(XXIX)

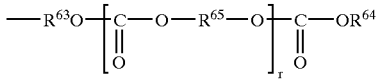

wherein $R^{63}$ and $R^{64}$ each represent an alkyl group having from 1 to 15 carbon atoms, or a monovalent alcohol residue having from 2 to 12 carbon atoms, and they may be the same or different; $R^{65}$ represents an alkylene group having from 2 to 12 carbon atoms; and r indicates an integer of from 0 to 30.

In formula (XXIX), $R^{63}$ and $R^{64}$ each are an alkyl group having from 1 to 15 carbon atoms, preferably from 2 to 9 carbon atoms, or a monovalent alcohol residue having from 2 to 12 carbon atoms, preferably from 2 to 9 carbon atoms; $R^{65}$ is an alkylene group having from 2 to 12 carbon atoms, preferably from 2 to 9 carbon atoms; and r is an integer of from 0 to 30, preferably from 1 to 30. Other carbonates not satisfying the above-mentioned conditions are unfavorable, since their properties, such as compatibility with refrigerants, are poor. The alkyl group having from 1 to 15 carbon atoms for $R^{63}$ and $R^{64}$ are, for example, a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an isopropyl group, an isobutyl group, a tert-butyl group, an isopentyl group, an isohexyl group, an isoheptyl group, an isooctyl group, an isononyl group, an isodecyl group, an isoundecyl group, an isododecyl group, an isotridecyl group, an isotetradecyl group, an isopentadecyl group, etc.

The dialcohol residue having from 2 to 12 carbon atoms may be, for example, a residue of ethylene glycol, 1,3-propanediol, propylene glycol, 1,4-butanediol, 1,2-butanediol, 8-methyl-1,3-propanediol, 1,5-pentanediol, neopentylene glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, 1,12-dodecanediol, etc.

The alkylene group having from 2 to 12 carbon atoms for $R^{65}$ may have a linear or branched structure, including, for example, an ethylene group, a trimethylene group, a propylene group, a tetramethylene group, a butylene group, a 2-methyltrimethylene group, a pentamethylene group, a 2,2-dimethyltrimethylene group, a hexamethylene group, a 2-ethyl-2-methyltrimethylene group, a heptamethylene group, a 2-methyl-2-propyltrimethylene group, a 2,2-diethyltrimethylene group, an octamethylene group, a nonamethylene group, a decamethylene group, an undecamethylene group, a dodecamethylene group, etc.

The molecular weight of the above-mentioned carbonates is not specifically defined, but in view of their ability to more tightly seal compressors, the number-average molecular weight thereof preferably falls between 200 and 3,000, more preferably between 300 and 2,000.

The carbonates mentioned above are described in detail in Japanese Patent Laid-Open No. 63893/1992, and those described therein are all employable herein.

The polyol ketones <6> may be, for example, compounds of a general formula (XXX):

(XXX)

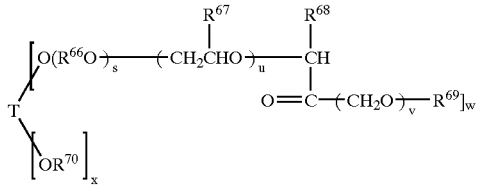

wherein T represents a mono- to octa-alcohol residue; $R^{66}$ represents an alkylene group having from 2 to 4 carbon atoms; $R^{67}$ represents a methyl group or an ethyl group; $R^{68}$ and $R^{70}$ each represent a hydrogen atom, or an aliphatic, aromatic or aroaliphatic hydrocarbon group having at most 20 carbon atoms, and they may be the same or different; $R^{69}$ represents an aliphatic, aromatic or aroaliphatic hydrocarbon residue having at most 20 carbon atoms; s and u each indicate a number of from 0 to 30; w indicates a number of from 1 to 8; x indicates a number of from 0 to 7, provided that (w+x) falls between 1 and 8; and v indicates 0 or 1.

In formula (XXX), T is a mono- to octa-alcohol residue. The alcohol to give the residue T includes monoalcohols, for example, aliphatic monoalcohols such as methyl alcohol, ethyl alcohol, linear or branched propyl alcohol, linear or branched butyl alcohol, linear or branched pentyl alcohol, linear or branched hexyl alcohol, linear or branched heptyl alcohol, linear or branched octyl alcohol, linear or branched nonyl alcohol, linear or branched decyl alcohol, linear or branched undecyl alcohol, linear or branched dodecyl alcohol, linear or branched tridecyl alcohol, linear or branched tetradecyl alcohol, linear or branched pentadecyl alcohol, linear or branched hexadecyl alcohol, linear or branched heptadecyl alcohol, linear or branched octadecyl alcohol, linear or branched nonadecyl alcohol, linear or branched eicosyl alcohol, etc.; aromatic alcohols such as phenol, methylphenol, nonylphenol, octylphenol, naphthol, etc.; aroaliphatic alcohols such as benzyl alcohol, phenylethyl alcohol, etc.; and their partially-etherified derivatives; dialcohols, for example, linear or branched aliphatic alcohols such as ethylene glycol, propylene glycol, butylene glycol, neopentylene glycol, tetramethylene glycol, etc.; aromatic alcohols such as catechol, resorcinol, bisphenol A, bisphenyldiol, etc.; and their partially-etherified derivatives; trialcohols, for example, linear or branched aliphatic alcohols such as glycerin, trimethylolpropane, trimethylolethane, trimethylolbutane, 1,3,5-pentanetriol, etc.; aromatic alcohols such as pyrogallol, methylpyrogallol, 5-sec-butylpyrogallol, etc.; and their partially-etherified derivatives; tetra- to octa-alcohols, for example aliphatic alcohols such as pentaerythritol, diglycerin, sorbitan, triglycerin, sorbitol, dipentaerythritol, tetraglycerin, pentaglycerin, hexaglycerin, tripentaerythritol, etc.; and their partially-etherified derivatives.

In formula (XXX), the alkylene group having from 2 to 4 carbon atoms for $R^{66}$ may be linear or branched, including, for example, an ethylene group, a propylene group, an ethylethylene group, a 1,1-dimethylethylene group, a 1,2-dimethylethylene group, etc. The aliphatic, aromatic or aroaliphatic hydrocarbon group having at most 20 carbon atoms for $R^{68}$ to $R^{70}$ includes, for example, linear alkyl groups such as a methyl group, an ethyl group, a propyl group, a butyl group, a pentyl group, a heptyl group, an octyl group, a nonyl group, a decyl group, an undecyl group, a lauryl group, a myristyl group, a palmityl group, a stearyl group, etc.; branched alkyl groups such as an isopropyl group, an isobutyl group, an isoamyl group, a 2-ethylhexyl group, an isostearyl group, a 2-heptylundecyl group, etc.; aryl groups such as a phenyl group, a methylphenyl group, etc.; and arylalkyl groups such as a benzyl group, etc.

In formula (XXX), s and u each are a number of from 0 to 30. If s and u each are larger than 30, the ether groups in the molecule participate too much in the behavior of the molecule, resulting in that the compounds having such many ether groups are unfavorable in view of their poor compatibility with refrigerants, their poor electric insulating properties and their high hygroscopicity. w is a number of from 1 to 8, x is a number of from 0 to 7, and (w+x) shall fall between 1 and 8. These numbers are mean values and are therefore not limited to only integers. v is 0 or 1. $R^{66}$'s of a number of (s×w) may be the same or different; and $R^{67}$'S of a number of (u×w) may also be the same or different. Where w is 2 or more, s's, u's, v's, $R^{68}$'s and $R^{69}$'s of the number of w each may be the same or different. Where x is 2 or more, $R^{70}$'s of the number of x may be the same or different.

To produce the polyether ketones of formula (XXX), employable are any known methods. For example, employable is a method of oxidizing a secondary alkyloxyalcohol with a hypochlorite and acetic acid (see Japanese Patent Laid-Open No. 126716/1992); or a method of oxidizing the alcohol with zirconium hydroxide and a ketone (see Japanese Patent Laid-Open No. 167149/1991).

The fluorinated oils <7> include, for example, fluorosilicone oils, perfluoropolyethers, reaction products of alkanes and perfluoroalkyl vinyl ethers, etc. For examples of the reaction products of alkanes and perfluoroalkyl vinyl ethers, mentioned are compounds of a general formula (XXXIII):

$$C_nH_{(2n+2-y)}(CF_2{=}CFHOC_mF_{2m+1})_y \quad \text{(XXXIII)}$$

wherein y indicates an integer of from 1 to 4; n indicates an integer of from 6 to 20; and m indicates an integer of from 1 to 4, which are obtained by reacting an alkane of a general formula (XXXI):

$$C_nH_{2n+2} \quad \text{(XXXI)}$$

wherein n has the same meaning as above, and a perfluoroalkyl vinyl ether of a general formula (XXXII):

$$CF_2{=}CFOC_mF_{2m+1} \quad \text{(XXXII)}$$

wherein m has the same meaning as above.

The alkane of formula (XXXI) may be linear, branched or cyclic, including, for example, n-octane, n-decane, n-dodecane, cyclooctane, cyclododecane, 2,2,4-trimethylpentane, etc. Examples of the perfluoroalkyl vinyl ether of formula (XXXII) are perfluoromethyl vinyl ether, perfluoroethyl vinyl ether, perfluoro-n-propyl vinyl ether, perfluoro-n-butyl vinyl ether, etc.

The invention is described in more detail with reference to the following Examples, which, however, are not intended to restrict the scope of the invention.

EXAMPLE I-1, COMPARATIVE EXAMPLES 1–1, I-2, AND REFERENCE EXAMPLE I-1

The base oil used herein is a polyvinyl ethyl ether (a)/polyisobutyl ether (b) random copolymer [unit (a)/unit (b)=9/1; kinematic viscosity 68 $mm^2$/sec (40° C.); number-average molecular weight 720]. To the base oil, added were the additives shown in Table I-1 to prepare refrigerator oil compositions. In Table I-1, the amount of each additive indicated is based on the total amount of the composition. The compositions were tested for their lubricity in an extreme-pressure region (hereinafter referred to as extreme-pressure lubricity) and in an oil region (hereinafter referred to as oil-region lubricity) in the manner mentioned below. The test results are shown in Table I-1, in which Example 1 is Example I-1 and the same shall apply to Comparative Examples and Reference Example.

[Extreme-Pressure Lubricity]

Testing Machine: Falex abrasion tester

Materials: block/pin=A390 (aluminium)/AISI-3135 (steel)

Oil Temperature: room temperature

Load: 1,000 lbs (4,450 N)

Rotation: 290 rpm

Test Time: 30 min

Atmosphere: R134a (blown)

Tested Matter: abrasion loss (mm) of block

Test Method: ASTM D 2670-94

[Oil-Region Lubricity]

Testing Machine: sealed block-on-ring tester

Materials: block/ring=A4032 (aluminium)/FC250 (cast iron)

Oil Temperature: 70° C.

Load: 10 kg (100 N)

Rotation: 300 rpm

Test Time: 30 min

Atmosphere: R134a sealed (0.6 MPa)

Tested Matter: abrasion loss (mm) of block

Test Method: Proceedings of the 1998 International Refrigeration Conference at Purdue (1998), page 379 referred to.

TABLE I-1

| | | Example 1 | Comp. Ex. 1 | Comp. Ex. 2 | Ref. Ex. 1 |
|---|---|---|---|---|---|
| Blend Ratio (wt. %) | Polyalcohol Ester*1 | 0.5 | 0.5 | — | — |
| | Acid Phosphate Amine Salt*2 | 0.01 | — | 0.01 | — |
| | Other Additives*3 | 0.7 | 0.7 | 0.7 | 0.7 |
| Extreme-Pressure Lubricity: abrasion loss (mm) | | 0.47 | 0.70 | 0.49 | 1.13 |
| Oil-Region Lubricity: abrasion loss (mm) | | 1.5 | 1.6 | 1.8 | 2.2 |
| Volume Resistivity (Ω/cm) | | $5 \times 10^{13}$ | $5 \times 10^{13}$ | $5 \times 10^{13}$ | $1 \times 10^{14}$ |

(Notes)

*1: glycerin mono-oleate

*2: oleyl acid phosphate amine salt

*3: antioxidant (phenolic compound), acid-trapping agent (epoxy compound), defoaming agent (silicone compound)

From Table I-1, it is understood that the two additives in the refrigerator oil composition of the invention synergistically improve both the extreme-pressure lubricity and the oil-region lubricity of the composition.

[Second Aspect of the Invention]

In this section, the second aspect of the invention will be simply referred to as "the invention".

The invention is described in detail hereinunder.

In the refrigerator oil composition of the invention, the base oil is a mineral oil and/or a synthetic oil. Not specifically defined, the mineral oil and the synthetic oil may be any ones generally used for the base oil of ordinary refrigerator oil. Preferably, they have a kinematic viscosity at 40° C. of from 2 to 500 $mm^2$/sec, more preferably from 5 to 200 $mm^2$/sec, even more preferably from 10 to 100 $mm^2$/sec. Their pour point that indicates the low-temperature flowability of the base oil is preferably not higher than −10° C.

Various types of such mineral oils and synthetic oils are known, and the base oil to be in the refrigerator oil composition of the invention may be suitably selected from them, depending on the use of the composition. For example, the mineral oils include paraffinic mineral oils, naphthenic mineral oils, and intermediate base mineral oils. The synthetic oils include oxygen-containing synthetic oils and hydrocarbon-type synthetic oils.

The oxygen-containing synthetic oils include those having any of ether groups, ketone groups, ester groups, carbonate groups and hydroxyl groups in the molecule, and those additionally having hetero atoms (e.g., S, P, F, Cl, Si, N) in addition to such groups. Concretely, they are <1> polyvinyl ethers, <2> polyol esters, <3> polyalkylene glycols, <4> polyesters, <5> carbonate derivatives, <6> polyether ketones, <7> fluorinated oils, etc. These are described in detail in the section of the first aspect of the invention.

The hydrocarbon-type synthetic oils are, for example, olefinic polymers such as poly-α-olefins, and alkylbenzenes, alkylnaphthalenes, etc.

The refrigerator oil composition of the invention may comprise, as the base oil, one or more of the above-mentioned mineral oils either singly or as combined, or one or more of the above-mentioned synthetic oils either singly or as combined, or even one or more such mineral oils and one or more such synthetic oils as combined. For the base oil, synthetic oils are preferred to mineral oils, and oxygen-containing synthetic oils are more preferred as well compatible with Flon refrigerants such as R-134a and having good lubricating properties. Of those, even more preferred are polyvinyl ethers, polyol esters and polyalkylene glycols.

The components (a) to (e) to be incorporated into the base oil are described.

Component (a)

For the acid phosphates for the component (a), referred to are those described hereinabove for the component (b) in the first aspect of the invention. For the amines to form the amine salts of acid phosphates, also referred to are those described hereinabove for the component (b) in the first aspect of the invention.

For the component (a), one or more compounds mentioned above may be used either singly or as combined.

The amount of the component (a) to be in the composition falls between 0.001 and 1% by weight based on the total amount of the composition. If it is too small, the object of the invention could not be sufficiently attained; and even if too large, it will not produce better results, and if too large, the solubility of the component (a) in the base oil rather lowers. Preferably, the amount of the component (a) falls between 0.003 and 0.05% by weight.

Component (b)

Acetylene glycols to form the acetylene glycol alkylene oxide adducts for the component (b) include 2-butyne-1,4-diol, 3-hexyne-2,5-diol, 2,5-dimethyl-3-hexyl-2,5-diol, 2,4,7,9-tetramethyl-5-decyne-4,7-diol, etc. To the acetylene glycol, added is an alkylene oxide such as ethylene oxide, propylene oxide or the like to form the adduct for use herein. The adduct is so controlled that its kinematic viscosity at 40° C. falls between 10 and 200 $mm^2$/sec (preferably between 30 and 100 $mm^2$/sec) and its hydroxyl value falls between 100 and 300 mgKOH/g.

For the component (b), one or more such adducts may be used either singly or as combined.

The amount of the component (b) to be in the composition falls between 0.01 and 5% by weight based on the total amount of the composition. If it is too small, the object of the invention could not be sufficiently attained; and even if too large, it will not produce better results, and if too large, the solubility of the component (b) in the base oil rather lowers. Preferably, the amount of the component (b) falls between 0.1 and 2% by weight.

Component (c)

Fatty acids in the potassium or sodium salts of fatty acids for the component (c) preferably have from 12 to 24 carbon atoms.

The fatty acids having from 12 to 24 carbon atoms may be linear or branched, and may be saturated or unsaturated.

Concretely, the linear saturated fatty acids include lauric acid, tridecylic acid, myristic acid, pentadecylic acid, palmitic acid, margaric acid, stearic acid, nonadecylic acid, arachic acid, behenic acid, lignoceric acid, etc.

Concretely, the linear unsaturated fatty acids include linderic acid, 5-lauroleic acid, tuduric acid, myristoleic acid, zoomaric acid, petroceric acid, oleic acid, elaidic acid, eicosenoic acid, erucic acid, selacholeic acid, etc.

Concretely, the branched saturated fatty acids include all isomers of methylundecanoic acid, all isomers of propylnonanoic acid, all isomers of methyldodecanoic acid, all isomers of propyldecanoic acid, all isomers of methyltridecanoic acid, all isomers of methyltetradecanoic acid, all isomers of methylpentadecanoic acid, all isomers of ethyltetradecanoic acid, all isomers of methylhexadecanoic acid, all isomers of propyltetradecanoic acid, all isomers of ethylhexadecanoic acid, all isomers of methylheptadecanoic acid, all isomers of butyltetradecanoic acid, all isomers of methyloctadecanoic acid, all isomers of ethyloctadecanoic acid, all isomers of methylnonadecanoic acid, all isomers of ethyloctadecanoic acid, all isomers of methyleicosanoic acid, all isomers of propyloctadecanoic acid, all isomers of butyloctadecanoic acid, all isomers of methyldocosanoic acid, all isomers of pentyloctadecanoic acid, all isomers of methyltricosanoic acid, all isomers of ethyldocosanoic acid, all isomers of propylhexaeicosanoic acid, all isomers of hexyloctadecanoic acid, 4,4-dimethyldecanoic acid, 2-ethyl-3-methylnonanoic acid, 2,2-dimethyl-4-ethyloctanoic acid, 2-propyl-3-methylnonanoicacid, 2,3-dimethyldodecanoic acid, 2-butyl-3-methylnonanoic acid, 3,7,11-trimethyldodecanoic acid, 4,4-dimethyltetradecanoic acid, 2-butyl-2-pentylheptanoic acid, 2,3-dimethyltetradecanoic acid, 4,8,12-trimethyltridecanoic acid, 14,14-dimethylpentadecanoic acid, 3-methyl-2-heptylnonanoic acid, 2,2-dipentylhetanoic acid, 2,2-dimethylhexadecanoic acid, 2-octyl-3-methylnonanoic acid, 2,3-dimethylheptadecanoic acid, 2,4-dimethylocatadecanoic acid, 2-butyl-2-heptylnonanoic acid, 20,20-dimethylheneicosanoic acid, etc.

The branched unsaturated fatty acids include 5-methyl-2-undecenoic acid, 2-methyl-2-dodecenoic acid, 5-methyl-2-tridecenoic acid, 2-methyl-9-octadecenoic acid, 2-ethyl-9-octadecenoic acid, 2-propyl-9-octadecenoic acid, 2-methyl-2-eicosenoic acid, etc. Of the fatty acids mentioned above, preferred are stearic acid, oleic acid, 16-methylheptadecanoic acid (isostearic acid), etc.

For the component (c), one or more compounds mentioned above may be used either singly or as combined.

The amount of the component (c) to be in the composition falls between 0.01 and 5% by weight based on the total amount of the composition. If it is too small, the object of the invention could not be sufficiently attained; and even if too large, it will not produce better results, and if too large, the solubility of the component (c) in the base oil rather lowers. Preferably, the amount of the component (c) falls between 0.05 and 2% by weight.

Component (d)

The component (d) is any of organic acids of the following general formula (XXXIV):

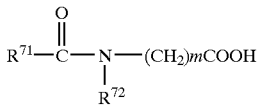

(XXXIV)

wherein $R^{71}$ represents an alkyl group having from 6 to 30 carbon atoms, or an alkenyl group having from 6 to 30 carbon atoms; $R^{72}$ represents an alkyl group having from 1 to 4 carbon atoms; and m indicates an integer of from 1 to 4.

Representing an alkyl group having from 6 to 30 carbon atoms, or an alkenyl group having from 6 to 30 carbon atoms, $R^{71}$ is preferably an alkyl group having from 10 to 20 carbon atoms, or an alkenyl group having from 10 to 20 carbon atoms. Representing an alkyl group having from 1 to 4, $R^{72}$ is preferably a methyl group. Indicating an integer of from 1 to 4, m is preferably 1. Preferred examples of the organic acids are N-oleoylsarcosine, N-stearoylsarcosine, N-palmitoylsarcosine, N-myristoylsarcosine, N-lauroylsarcosine, etc. For the component (d), one or more organic acids mentioned above may be used either singly or as combined.

The amount of the component (d) to be in the composition falls between 0.01 and 5% by weight based on the total amount of the composition. If it is too small, the object of the invention could not be sufficiently attained; and even if too large, it will not produce better results, and if too large, the solubility of the component (d) in the base oil rather lowers. Preferably, the amount of the component (d) falls between 0.05 and 2% by weight.

Component (e)

Fatty acids in the fatty acid amides for the component (e) preferably have from 12 to 24 carbon atoms. For their preferred examples, referred to are the same as those mentioned hereinabove for the component (c). For the component (e), one or more such fatty acid amides may be used either singly or as combined.

The amount of the component (e) to be in the composition falls between 0.01 and 5% by weight based on the total amount of the composition. If it is too small, the object of the invention could not be sufficiently attained; and even if too large, it will not produce better results, and if too large, the solubility of the component (e) in the base oil rather lowers. Preferably, the amount of the component (e) falls between 0.1 and 2% by weight.

The refrigerator oil composition of the invention may optionally contain, if desired, various known additives, for example, extreme pressure agents such as tricresyl phosphate, etc.; phenolic or amine-based antioxidants; acid-trapping agents such as epoxy compounds, e.g., phenyl glycidyl ether, cyclohexene-oxide, epoxidated soybean oil, etc.; copper-inactivating agents such as benzotriazole, benzotriazole derivatives, etc.; and defoaming agents such as silicone oils, fluorosilicone oils, etc.

The refrigerants to be used in refrigerators to which the refrigerator oil composition of the present invention is applied are, for example, hydrofluorocarbons, fluorocarbons, hydrocarbons, ethers, carbon dioxide-containing refrigerants, and ammonia-containing refrigerants. Of those, preferred are hydrofluorocarbons. Preferred examples of hydrofluorocarbons are 1,1,1,2-tetrafluoroethane (R134a), difluoromethane (R32), pentafluoroethane (R125) and 1,1,1-trifluouroethane (R143a). One or more of these may be used either singly or as combined. These hydrofluorocarbons are preferred for refrigerants for compression refrigerators, as there is no possibility of their destroying the ozone layer. Examples of mixed refrigerants to which the oil composition of the invention is also applicable are a mixture of R32, R125 and R134a in a ratio by weight of 23:25:52 (hereinafter referred to as R407C); a mixture thereof in a ratio by weight of 25:15:60; a mixture of R32 and P125 in a ratio by weight of 50:50 (hereinafter referred to as R410A); a mixture of R32 and R125 in a ratio by weight of 45:55 (hereinafter referred to as R410B); a mixture of R125, R143a and R134a in a ratio by weight of 44:52:4 (hereinafter referred to as R404A); a mixture of R125 and R143a in a ratio by weight of 50:50 (hereinafter referred to as R507), etc.

The invention is described in more detail with reference to the following Examples, which, however, are not intended to restrict the scope of the invention.

EXAMPLES II-2 TO II-5, COMPARATIVE EXAMPLE II-1, AND REFERENCE EXAMPLE II-1

The base oil used herein is a polyvinyl ethyl ether (a)/polyisobutyl ether (b) random copolymer [unit (a)/unit (b) 9/1; kinematic viscosity 68 $mm^2$/sec (40° C.); number-average molecular weight 720]. To the base oil, added were the additives shown in Table II-1 to prepare refrigerator oil compositions. In Table II-1, the amount of each additive indicated is based on the total amount of the composition. The compositions were tested for their lubricity in an extreme-pressure region (hereinafter referred to as extreme-pressure lubricity) and in an oil region (hereinafter referred to as oil-region lubricity) and for their volume resistivity in the manner mentioned below. The test results are shown in Table II-1, in which Example 1 is Example II-1 and the same shall apply to the other Examples, Comparative Example and Reference Example.

[Extreme-Pressure Lubricity]

Testing Machine: Falex abrasion tester

Materials: block/pin=A390 (aluminium)/AISI-3135 (steel)

Oil Temperature: room temperature

Load: 1,000 lbs (4,450 N)

Rotation: 290 rpm

Test Time: 30 min

Atmosphere: R134a (blown)

Tested Matter: abrasion loss (mm) of block

Test Method: ASTM D 2670-94

[Oil-Region Lubricity]

Testing Machine: sealed block-on-ring tester

Materials: block/ring=A4032 (aluminium)/FC250 (cast iron)

Oil Temperature: 70° C.

Load: 10 kg (100 N)

Rotation: 300 rpm

Test Time: 30 min

Atmosphere: R134a sealed (0.6 MPa)

Tested Matter: abrasion loss (mm) of block

Test Method: Proceedings of the 1998 International Refrigeration Conference at Purdue (1998), page 379 referred to.

TABLE II-1

(1)

| | | Example 1 | Example 2 | Example 3 | Example 4 |
|---|---|---|---|---|---|
| Blend Ratio (wt. %) | Component (a)*1 | 0.01 | — | — | — |
| | Component (b)*2 | — | 1.0 | — | — |
| | Component (c)*3 | — | — | 0.3 | — |
| | Component (d)*4 | — | — | — | 0.3 |
| | Component (e)*5 | — | — | — | — |
| | Sorbitan Mono-oleate | — | — | — | — |
| | Other Additives*6 | 0.7 | 0.7 | 0.7 | 0.7 |
| Extreme-Pressure Lubricity: abrasion loss (mm) | | 0.49 | — | — | — |
| Oil-Region Lubricity: abrasion loss (mm) | | — | 1.3 | 1.4 | 1.5 |
| Volume Resistivity (Ω/cm) | | $5 \times 10^{13}$ | $1 \times 10^{13}$ | $5 \times 10^{13}$ | $5 \times 10^{13}$ |

(2)

| | | Example 4 | Comp. Ex. 1 | Ref. Ex. 1 |
|---|---|---|---|---|
| Blend Ratio (wt. %) | Component (a)*1 | — | — | — |
| | Component (b)*2 | — | — | — |
| | Component (c)*3 | — | — | — |
| | Component (d)*4 | — | — | — |
| | Component (e)*5 | 1.0 | — | — |
| | Sorbitan Mono-oleate | — | 0.5 | — |
| | Other Additives*6 | 0.7 | 0.7 | 0.7 |
| Extreme-Pressure Lubricity: abrasion loss (mm) | | — | — | 1.13 |
| Oil-Region Lubricity: abrasion loss (mm) | | 1.3 | 1.5 | 2.2 |
| Volume Resistivity (Ω/cm) | | $5 \times 10^{13}$ | $5 \times 10^{11}$ | $1 \times 10^{14}$ |

(Notes)

1: oleic acid phosphate amine salt

2: 2,4,7,9-tetramethyl-5-decyne-4,7-diol/ethylene oxide adduct

3: potassium oleate

4: N-oleoylsarcosine

5: oleamide

6: antioxidant (phenolic compound), acid-trapping agent (epoxy compound), defoaming agent (silicone compound).

From Table II-1, it is understood that the refrigerator oil compositions of the invention all exhibit good lubricity both in the extreme-pressure region and in the oil region, and their volume resistivity is low.

INDUSTRIAL APPLICABILITY

The invention provides refrigerator oil compositions of good lubricity, which are especially effective for reducing the friction in both the oil region and the extreme-pressure region in the sliding area between aluminium materials and steel materials and which are favorable to lubricating oil for refrigerators using non-chlorine Flon refrigerants such as R134a and the like that do not bring about environmental pollution. Accordingly, the refrigerator oil compositions of the invention are applicable to all types of compressor refrigerators such as rotary-type, scroll-type and reciprocation-type compressor refrigerators.

What is claimed is:

1. A refrigerator oil composition comprising a polyvinyl ether as a base oil, and containing, based on the total amount of the composition, (a) from 0.01 to 5% by weight of a partial ester of a polyalcohol and a fatty acid, and (b) from 0.001 to 1% by weight of an acid phosphate or its amine salt, wherein the acid phosphate is an orthophosphate of the following formula (I) or (II):

(I)

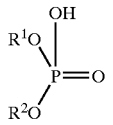

(II)

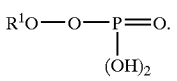

wherein $R^1$ and $R^2$ each, independently, represent an alkyl, alkenyl, alkylaryl or lalkyl group having from 4 to 30 carbon atoms.

2. The refrigerator oil composition as claimed in claim 1, wherein the component (a) is a partial ester of a tri- or tetra-alcohol and a fatty acid having from 12 to 24 carbon atoms.

3. The refrigerator oil composition as claimed in claim 1, wherein the polyvinyl ether is a polyvinyl ether copolymer having constitutive units (A) of the following general formula (XIX):

(XIX)

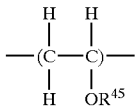

wherein $R^{45}$ represents a hydrocarbon group having from 1 to 3 carbon atoms and having or not having an ether bond in the molecule, and constitutive units (B) of the following general formula (XX):

(XX)

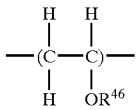

wherein $R^{46}$ represents a hydrocarbon group having from 3 to 20 carbon atoms and having or not having an ether bond in the molecule, in which, $R^{45}$ in the constitutive units (A) is not the same as $R^{46}$ in the constitutive units (B).

4. The refrigerator oil composition as claimed in claim 3, wherein $R^{45}$ in the constitutive units (A) is an ethyl group, and $R^{46}$ in the constitutive units (B) is an isobutyl group.

5. The refrigerator oil composition as claimed in claim 1, which comprises the orthophosphate of formula (I).

6. The refrigerator oil composition as claimed in claim 1, which comprises the orthophosphate of formula (II).

7. A refrigerator oil composition comprising a base oil of a mineral oil and/or a synthetic oil, and containing at least one compound selected from the group consisting of (a) acid phosphates or their amine salts, (b) acetylene glycol alkylene oxide adducts, (c) potassium or sodium salts of fatty acids, (d) organic acids of the following general formula (XXXIV):

(XXXIV)

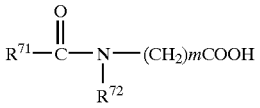

wherein $R^{71}$ represents an alkyl group having from 6 to 30 carbon atoms, or an alkenyl group having from 6 to 30 carbon atoms; $R^{72}$ represents an alkyl group having from 1 to 4 carbon atoms; and m indicates an integer of from 1 to 4, and (e) fatty acid amides.

8. The refrigerator oil composition as claimed in claim 7, wherein the amount of the component (a) falls between 0.001 and 1% by weight based on the total amount of the composition.

9. The refrigerator oil composition as claimed in claim 7, wherein the amount of the component (b), that of the component (c), that of the component (d) and that of the component (e) each fall between 0.01 and 5% by weight based on the total amount of the composition.

10. The refrigerator oil composition as claimed in claim 7, wherein the base oil is an oxygen-containing synthetic oil.

11. The refrigerator oil composition as claimed in claim 10, wherein the oxygen-containing synthetic oil is at least one selected from polyvinyl ethers, polyol esters and polyalkylene glycols.

12. The refrigerator oil composition as claimed in claim 11, wherein the polyvinyl ethers are polyvinyl ether copolymers having constitutive units (A) of the following general formula (XIX):

(XIX)

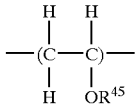

wherein $R^{45}$ represents a hydrocarbon group having from 1 to 3 carbon atoms and having or not having an ether bond in the molecule, an constitutive units (B) of the following general formula (XX):

(XX)

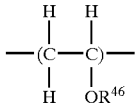

wherein $R^{46}$ represents a hydrocarbon group having from 3 to 20 carbon atoms and having or not having an ether bond in the molecule, in which, $R^{45}$ in the constitutive units (A) is not the same as $R^{46}$ in the constitutive units (B).

13. The refrigerator oil composition as claimed in claim 12, wherein $R^{45}$ in the constitutive units (A) is an ethyl group, and $R^{46}$ in the constitutive units (B) is an isobutyl group.

14. The refrigerator oil composition as claimed in claim 7, which comprises (a).

15. The refrigerator oil composition as claimed in claim 7, which comprises (b).

16. The refrigerator oil composition as claimed in claim 7, which comprises (c).

17. The refrigerator oil composition as claimed in claim 7, which comprises (d).

18. The refrigerator oil composition as claimed in claim 7, which comprises (e).

* * * * *